US009984523B1

(12) United States Patent
Shen

(10) Patent No.: US 9,984,523 B1
(45) Date of Patent: May 29, 2018

(54) CONTROL SYSTEM FOR LOCK DEVICES

(71) Applicant: I-Ting Shen, Tainan (TW)

(72) Inventor: I-Ting Shen, Tainan (TW)

( * ) Notice: Subject to any disclaimer, the term of this patent is extended or adjusted under 35 U.S.C. 154(b) by 0 days. days.

(21) Appl. No.: 15/491,426

(22) Filed: Apr. 19, 2017

(30) Foreign Application Priority Data

Mar. 17, 2017 (TW) ..... 106109039

(51) Int. Cl.
*G07C 9/00* (2006.01)

(52) U.S. Cl.
CPC ..... *G07C 9/00563* (2013.01)

(58) Field of Classification Search
None
See application file for complete search history.

(56) References Cited

U.S. PATENT DOCUMENTS 9,619,954 B2 * 4/2017 Allibhoy ..... G07C 9/00309
9,728,017 B2 * 8/2017 Paquin ..... G07C 9/00007

* cited by examiner

*Primary Examiner* — K Wong
(74) *Attorney, Agent, or Firm* — Alan D. Kamrath; Kamrath IP Lawfirm, P.A.

(57) ABSTRACT

A control system includes an electronic key storing identification data. The electronic key includes a biological feature pickup device for inputting biological feature identification information. The electronic key can be paired with at least one lock device. When the electronic key is connected to the at least one lock device, the at least one lock device reads the identification data in a main memory of the electronic key for comparison with authenticated identification information stored in the at least one lock device. Furthermore, the biological feature identification information is compared with authenticated biological feature identification information stored in the at least one lock device. Thus, the at least one lock device can be controlled to be in a locked state or an unlocked state. Thus, a single electronic key can be used to control a plurality of lock devices of different security levels.

5 Claims, 5 Drawing Sheets

CONTROL SYSTEM FOR LOCK DEVICES

BACKGROUND OF THE INVENTION

The present invention relates to a control system for lock devices and, more particularly, to a control system using identification information together with or without biological identification information to unlock at least one lock device.

Mechanical locks have been used in various applications mainly for anti-burglar functions. As an example, a lock mounted on a door (namely, a door lock) can lock the door to achieve an anti-burglar function, avoiding opening by persons without the correct key. In another example, a lock can be used to lock a wheel of a motorcycle to prevent movement of the motorcycle to thereby achieve an anti-burglar function. These mechanical locks have a common feature; that is each lock has its own key. Door locks have door keys, and motorcycle locks have their own keys. As a result, people often carry many keys and have to remember each key and its corresponding lock, which is inconvenient to use.

A type of currently available electric lock can be locked or unlocked by a door access card or a smart phone. Technically, all electric locks of the same type can be locked or unlocked by the same door access card or smart phone, which is convenient to use. However, when the door access card or smart phone is lost, a person that picks up the door access card or smart phone can unlock all of the electric locks of the same type. The anti-burglar function is, thus, poorer than the mechanical locks each having its own key. Furthermore, if each electric lock of its own type has its own door access card, the user has to carry many door access cards (which is similar to the case of mechanical locks) and has to remember each door access card and its corresponding electric lock, which is inconvenient to use.

Another problem to the user losing his or her door access card is that a person picking up the door access card can use it to unlock the corresponding lock, causing trouble to the user.

A hinting device can be applied on an electric key to remind the holder of the electric key to use a biological feature pickup module to input the biological feature identification information to a lock device of a higher security level. Thus, the user of the electric key does not have to remember which lock is of a higher security level, providing better use convenience. However, use of the electronic key is still limited.

BRIEF SUMMARY OF THE INVENTION

In a first aspect, a control system includes a first lock device having a first control module and a first connecting module electrically connected to the first control module. The first lock device further includes a first lock body controlled by the first control module to be in a locked state or an unlocked state. The first lock device further includes a first memory electrically connected to the first control module. First authenticated identification information and authenticated biological identification information are stored in the first memory. A second lock device includes a second control module and a second connecting module electrically connected to the second control module. The second lock device further includes a second lock body controlled by the second control module to be in a locked state or an unlocked state. The second lock device further includes a second memory electrically connected to the second control module. Second authenticated identification information is stored in the second memory. An electronic key includes a processing module, a main connecting module, and a biological feature pickup device. The main connecting module and the biological feature pickup device are electrically connected to the processing module. The electronic key further includes a main memory and a hinting module. The main memory and the hinting memory are electrically connected to the processing module. Identification data is stored in the main memory. The main connecting module is selectively connected to the first connecting module or the second connecting module.

When the main connecting module of the electronic key is connected to the first connecting module of the first lock device, the hinting module operates to generate a hinting message reminding a holder of the electronic key to use the biological feature pickup module to input biological feature information. Furthermore, the first lock device reads the identification data of the electronic key and the biological feature identification information inputted by the holder. If the first control module identifies that the identification data of the electronic key matches the first authenticated identification information and that the biological identification information matches the authenticated biological identification information, the first control module controls the first lock body to be in the unlocked state. If the first control module identifies that the identification data of the electronic key does not match the first authenticated identification information or the biological identification information does not match the authenticated biological identification information, the first control module controls the first lock body to be in the locked state.

When the main connecting module of the electronic key is connected to the second connecting module of the second lock device, the hinting module does not operate, and the second lock device reads the identification data of the electronic key. If the second control module identifies that the identification data of the electronic key matches the second authenticated identification information, the second control module controls the second lock body to be in the unlocked state. If the second control module identifies that the identification data of the electronic key does not match the second authenticated identification information, the second control module controls the second lock body to be in the locked state.

In an example, the electronic key is a door access card, and the hinting device is a light emitting diode.

In an example, the electronic key further includes a power supply device electrically connected to the processing module. Each of the main connecting module, the first connecting module, and the second connecting module is a wireless connecting device. The power supply device is magnetically inductive wireless charging equipment or magnetic resonance wireless charging equipment. When the electronic key is electrically connected to the first lock device or the second lock device, the power supply device generates electric current through magnetic induction or magnet resonance and supplies electricity to the processing module, the hinting module, the main memory, the main connecting module, and the biological feature pickup module.

In another example, the electronic key is a smart phone. The hinting device is at least one of a screen for displaying a hinting message and a speaker of the smart phone for generating hinting sound. The hinting device, when operated, generates at least one of the screen with the hinting device and the hinting sound for hinting the holder to input the biological feature.

In an example, a power supply device is electrically connected to the processing module. Each of the main connecting module, the first connecting module, and the second connecting module is a wireless connecting device. The power supply device is a battery of a smart phone.

In a second aspect, a control system includes a first lock device having a first control module and a first connecting module electrically connected to the first control module. The first lock device further includes a first lock body controlled by the first control module to be in a locked state or an unlocked state. The first lock device further includes a first memory electrically connected to the first control module. First authenticated identification information and authenticated biological identification information are stored in the first memory. An electronic key includes a processing module, a main connecting module, and a biological feature pickup device. The main connecting module and the biological feature pickup device are electrically connected to the processing module. The electronic key further includes a main memory and a hinting module. The main memory and the hinting memory are electrically connected to the processing module. Identification data is stored in the main memory. The main connecting module can be connected to the first connecting module.

When the main connecting module of the electronic key is connected to the first connecting module of the first lock device, the hinting module operates to generate a hinting message reminding a holder of the electronic key to use the biological feature pickup module to input biological feature information. Furthermore, the first lock device reads the identification data of the electronic key and the biological feature identification information inputted by the holder. If the first control module identifies that the identification data of the electronic key matches the first authenticated identification information and that the biological identification information matches the authenticated biological identification information, the first control module controls the first lock body to be in the unlocked state. If the first control module identifies that the identification data of the electronic key does not match the first authenticated identification information or the biological identification information does not match the authenticated biological identification information, the first control module controls the first lock body to be in the locked state.

In an example, the electronic key further includes a power supply device electrically connected to the processing module. Each of the main connecting module and the first connecting module is a wireless connecting device. The power supply device is magnetically inductive wireless charging equipment or magnetic resonance wireless charging equipment. When the electronic key is electrically connected to the first lock device, the power supply device generates electric current through magnetic induction or magnet resonance and supplies electricity to the processing module, the hinting module, the main memory, the main connecting module, and the biological feature pickup module.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

All figures are drawn for ease of explanation of the basic teachings only; the extensions of the figures with respect to number, position, relationship, and dimensions of the parts to form the illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

DETAILED DESCRIPTION OF THE INVENTION

Figure 1:
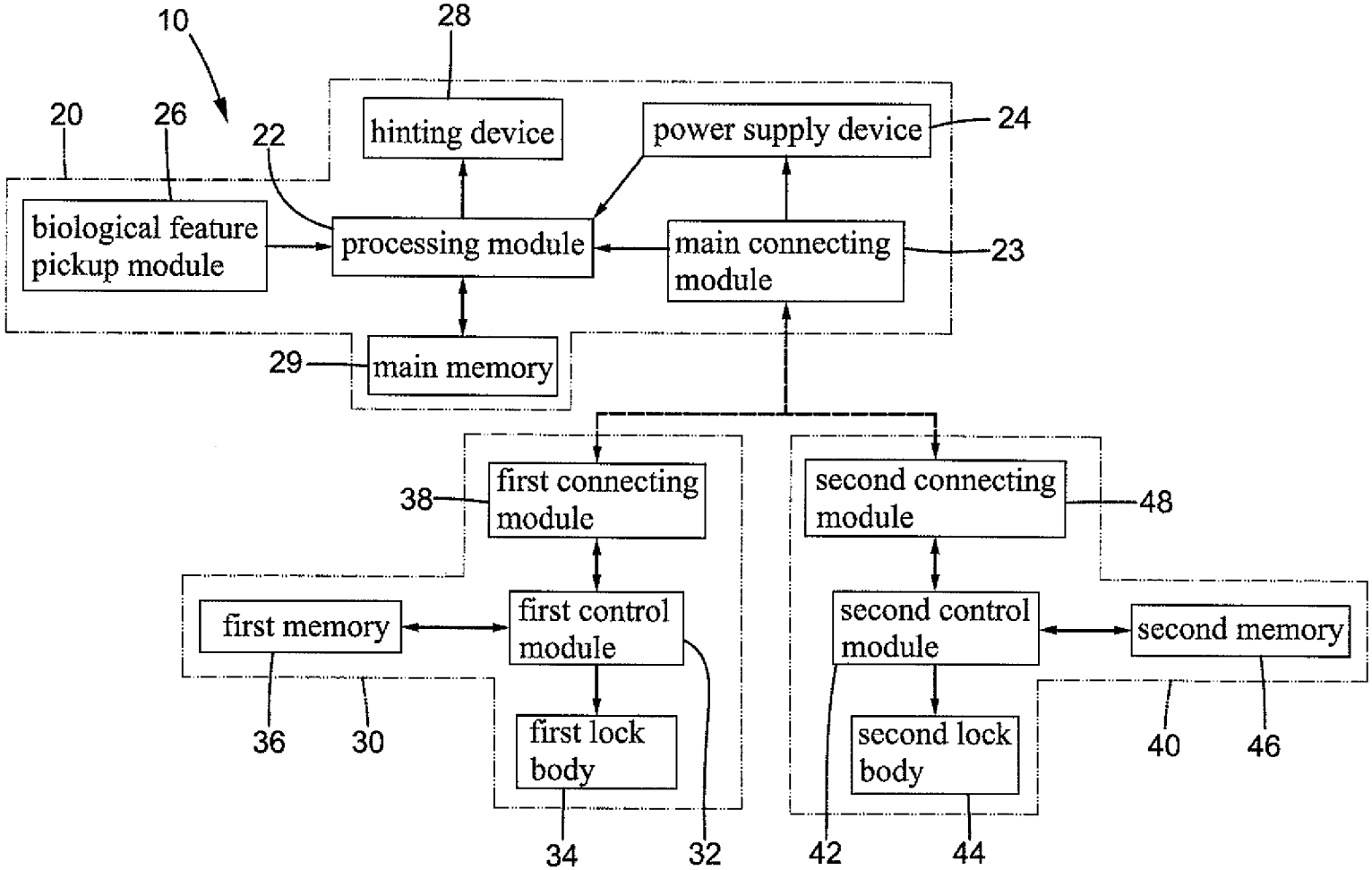
FIG. 1 is a diagrammatic block view of a control system for lock devices of an embodiment according to the present invention.
Figure 2:
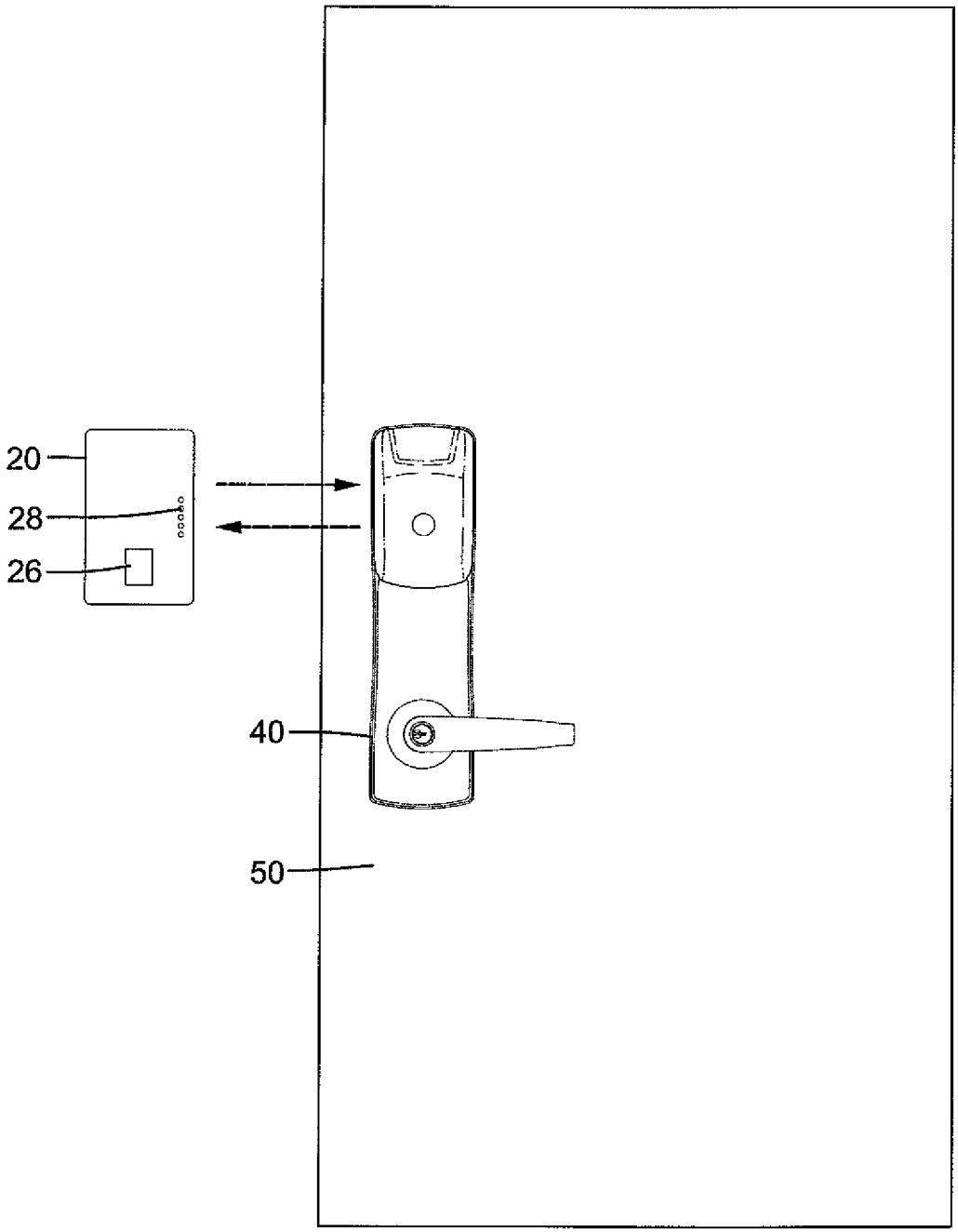
FIG. 2 is a diagrammatic view illustrating use of the control system on a door, with the control system using a door access card as an electronic key and with a second lock device mounted on the door.
Figure 3:
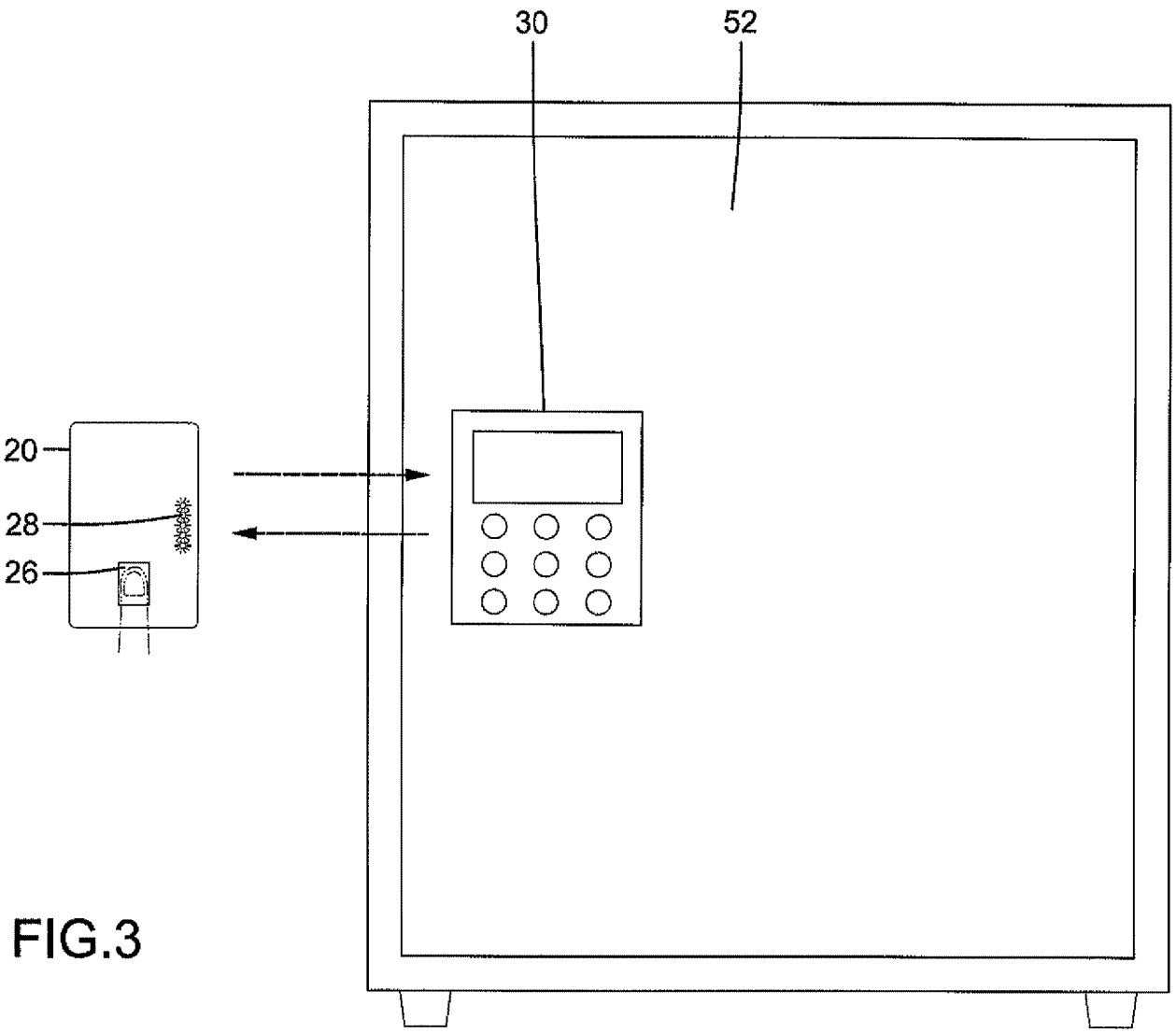
FIG. 3 is a diagrammatic view illustrating use of the control system on a safe, with the control system using a door access card as an electronic key and with a first lock device mounted on the safe.

With reference to FIG. 1, a control system for lock devices of an embodiment according to the present invention includes a first lock device 30 in the form of an electric lock that can be mounted in different locations, such as a door 50 (see FIG. 2), a safe 52 (see FIG. 3), a traffic tool, or any device or place requiring an anti-burglar function. The first lock device 30 includes a first control module 32 and a first lock body 34 electrically connected to and controlled by the first control module 32 to be in a locked state or an unlocked state. The first lock body 34 can include a mechanical mechanism and an electric mechanism (such as a motor or an electromagnetic valve).

The first lock device 30 further includes a first memory 36 electrically connected to the first control module 32. First authenticated identification information and authenticated biological identification information are stored in the first memory 36. The first lock device 30 further includes a first connecting module 38 electrically connected to the first control module 32. The first connecting module 38 can be a contact type electrical connection or a non-contact type wireless transmission module, such as Bluetooth, near field communication (NFC), Wi-Fi, or radio frequency identification (RFID).

The first control module 32, the first memory 36, and the first connecting module 38 cooperate with each other to control operation or non-operation of the electric mechanism of the first lock body 34 to actuate the mechanical mechanism of the first lock body 34. Thus, the first control module 32 controls the first lock body 34 to be in a locked state or an unlocked state.

The control system 10 further includes a second lock device 40 in the form of an electric lock that can be mounted in different locations, such as a door 50 (see FIG. 2), a safe 52 (see FIG. 3), a traffic tool, or any device or place requiring an anti-burglar function. The second lock device 40 includes a second control module 42 and a second lock body 44 electrically connected to and controlled by the second control module 42 to be in a locked state or an unlocked state. The second lock body 44 can include a mechanical mechanism and an electric mechanism (such as a motor or an electromagnetic valve).

The second lock device 40 further includes a second memory 46 electrically connected to the second control module 42. Second authenticated identification information is stored in the second memory 46. The second lock device 40 further includes a second connecting module 48 electrically connected to the second control module 42. The second connecting module 48 can be a contact type electrical connection or a non-contact type wireless transmission module, such as Bluetooth, near field communication (NFC), Wi-Fi, or radio frequency identification (RFID).

The second control module 42, the second memory 46, and the second connecting module 48 cooperate with each other to control operation or non-operation of the electric mechanism of the second lock body 44 to actuate the mechanical mechanism of the second lock body 44. Thus, the second control module 42 controls the second lock body 44 to be in a locked state or an unlocked state.

Although control system 10 includes a first lock device 30 and a second lock device 40 in this embodiment, control system 10 can include as many lock devices as desired.

Control system 10 further includes an electronic key 20. The electronic key 20 includes a processing module 22, a main connecting module 23, a power supply device 24, a biological feature pickup device 26, a hinting module 28, and a main memory 29. The main connecting module 23, the power device 24, the biological feature pickup device 26, the hinting module 28, and the main memory 29 are electrically connected to the processing module 22.

The power supply device 24 provides the electronic key 20 with electricity. Identification data is stored in the main memory 29 and can be a hardware identification code of the electronic key 20, an encrypted key, or biological feature identification information. The main connecting module 23 is selectively connected to the first connecting module 38 or the second connecting module 48. Similar to the first and second connecting modules 38 and 48, the main connecting module 23 can be a contact type electrical connection or a non-contact type wireless transmission module, such as Bluetooth, near field communication (NEC), Wi-Fi, or radio frequency identification (RFID). In an example, the first and second connecting modules 38 and 48 and the main connecting module 23 are wireless transmission modules using the same technique to save the costs.

Although only one electronic key 20 is used in this embodiment, the first and second lock devices 30 and 40 can cooperate with a plurality of electronic keys 20. The electronic key 20 can be a door access card or a smart phone. In a case that the electronic key 20 is a door access card (see FIGS. 2 and 3), the biological feature pickup module 26 can be a fingerprint pickup device or a finger vein pickup device. The power supply device 24 can be magnetically inductive wireless charging equipment or magnetic resonance wireless charging equipment. The hinting device 28 is a light emitting diode. When the door access card is near the first lock device 30 or the second lock device 40, the first connecting module 38 or the second connecting module 48 causes the power supply device 24 to generate electric current and supply electricity to the electronic key 20 for operation.

Figure 4:
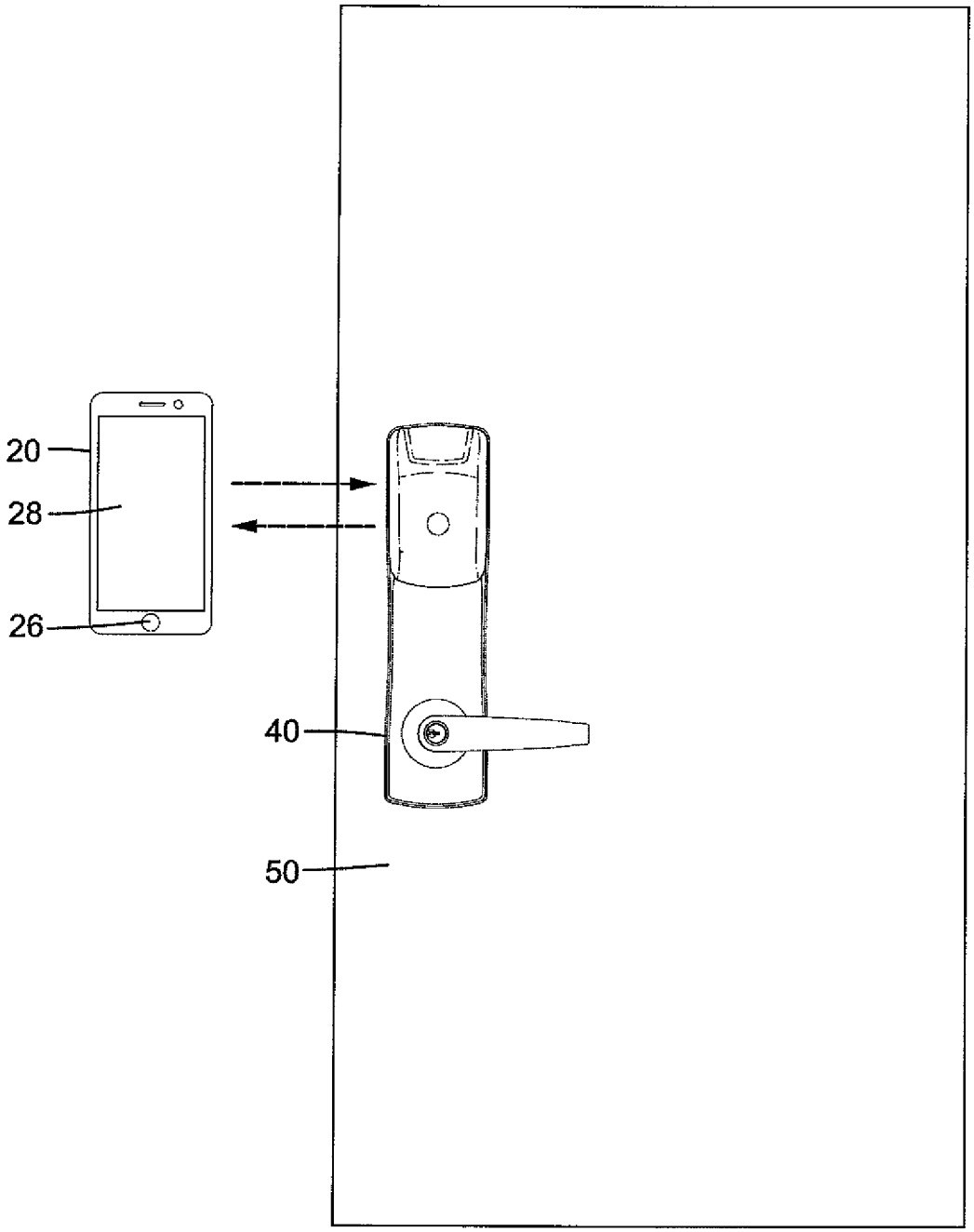
FIG. 4 is a diagrammatic view illustrating use of the control system on a door, with the control system using a mobile phone as an electronic key and with the second lock device mounted on the door.
Figure 5:
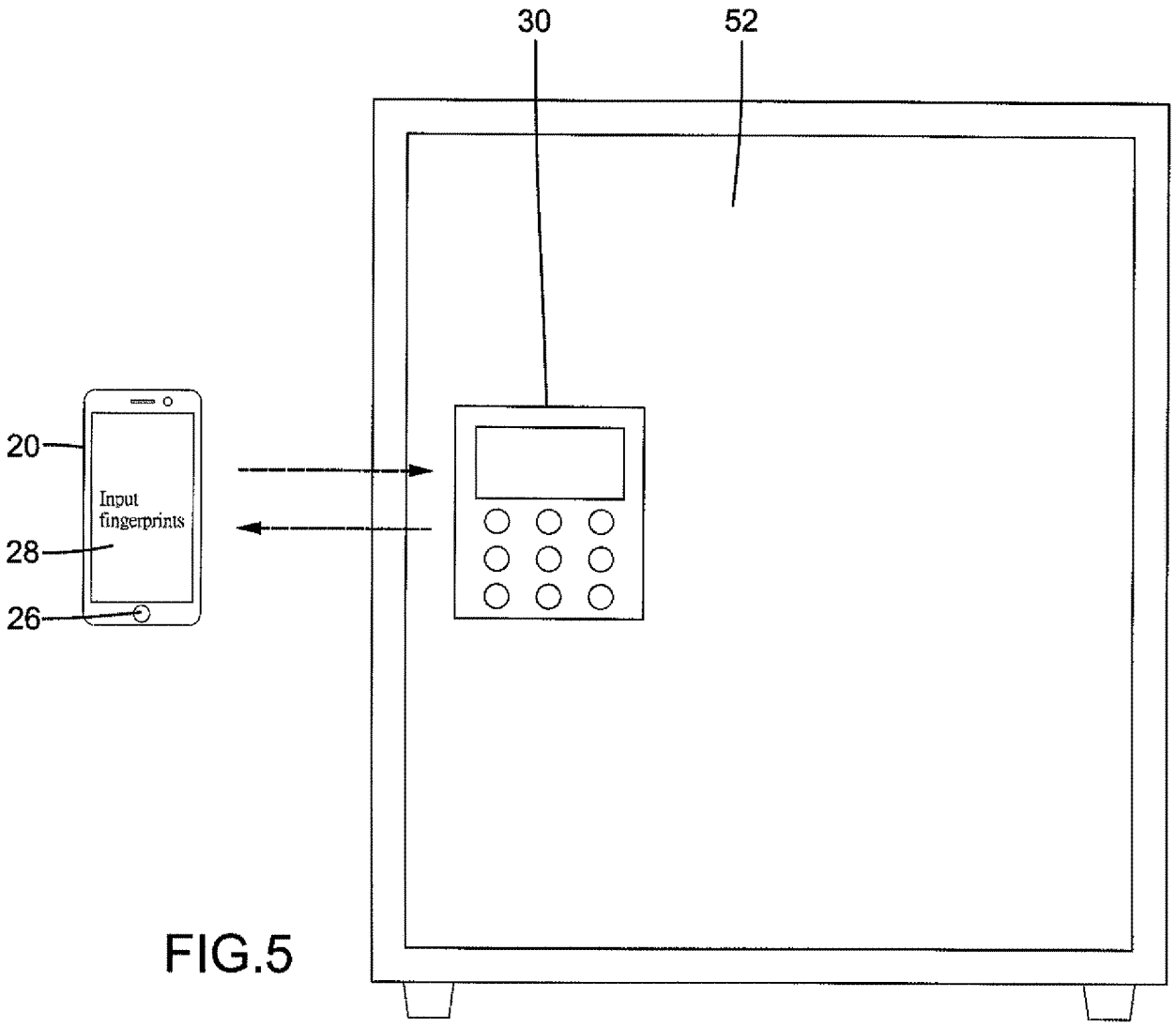
FIG. 5 is a diagrammatic view illustrating use of the control system on a safe, with the control system using a mobile phone as an electronic key and with the first lock device mounted on the safe.

In another case that the electronic key 20 is a smart phone (see FIGS. 4 and 5), the biological feature pickup module 26 can be a fingerprint pickup device, a finger vein pickup device, an iris pickup device, a facial feature pickup device, or a voice pickup device. The power supply device 24 is the battery of the smart phone. The hinting device 28 is at least one of a screen (for displaying a hinting message) and a speaker of the hinting device 28.

For the sake of explanation, it will be assumed that the electronic key 20 is a door access card (see FIGS. 2 and 3), the power supply device 24 is a wireless charging module using electromagnetic induction or magnetic resonance, and the biological feature pickup device 26 is a fingerprint pickup device. The first lock device 30 and the second lock device 40 pair with the door access card. The first memory 36 of the first lock device 30 stores the identification data of the door access card as the first authenticated identification information. The first memory 36 further stores the authenticated biological feature identification information. The second memory 46 of the second lock device 40 stores the identification data of the door access card as the second authenticated identification information.

It is further assumed that the first lock device 30 is a lock mounted on a safe 52 (FIG. 3) and is in the locked state. The second lock device 40 is a door lock mounted on a door 50 and is in a locked state. The safe 52 is mounted in a space at a side of the door 50. Thus, the door 50 and the safe 52 cannot be opened without the door access card.

When it is desired to open the door 50, the electronic key 20 is held to a location near the second lock device 40 on the door 50. Thus, the main connecting module 23 of the electronic key 20 is connected to the second connecting module 48 of the second lock device 40. Furthermore, the power supply device 24 detecting the wireless signal from the second connecting module 48 generates and supplies electric current to the processing module 22, the biological feature pickup device 26, the hinting device 28, and the main memory 29 for operation. Furthermore, the second lock device 40 reads the identification data in the main memory 29 of the electronic key 20 through connection of the second connecting module 48 of the second lock device 40 and the main connecting module 23. If the second control module 42 identifies that the identification data does not match the second authenticated identification information of the second memory 46, the second control module 42 controls the second lock body 44 to be in the locked state (or the second lock body 44 remains in the locked state). On the other hand, if the second control module 42 identifies that the identification data matches the second authenticated identification information of the second memory 46, the second control module 42 controls the second lock body 44 to be in the unlocked state.

When it is desired to open the safe 52, the same electronic key 20 is held to a location near the first lock device 30. Thus, the main connecting module 23 of the electronic key 20 is connected to the first connecting module 38 of the first lock device 30. Furthermore, the power supply device 24 detecting the wireless signal from the first connecting module 38 generates and supplies electric current to the processing module 22, the biological feature pickup device 26, the hinting device 28, and the main memory 29 for operation. Furthermore, the first lock device 30 sends a control signal to the electronic key 20 through connection between the first connecting module 38 and the main connecting module 23. After receiving the control signal, the processing module 22 of the electronic key 20 activates the hinting module 28 to emit light. Thus, the holder of the electronic key 20 can be hinted to use the biological feature pickup module 26 to input fingerprints (the biological feature identification information).

Furthermore, the first lock device 30 reads the identification data in the main memory 29 of the electronic key 20 through connection of the first connecting module 38 of the first lock device 30 and the main connecting module 23. If the first control module 32 identifies that the identification data does not match the first authenticated identification information of the first memory 36, the first control module 32 controls the first lock body 34 to be in the locked state (or the first lock body 34 remains in the locked state). On the other hand, if the first control module 32 identifies that the identification data matches the first authenticated identification information of the first memory 36, the first control module 32 controls the first lock body 34 to be in the unlocked state.

In another embodiment, the electronic key 20 can be a mobile phone, the hinting module 28 is at least one of the screen and the speaker of the mobile phone, and the power supply device 24 is the battery of the mobile phone. Namely, the electronic key 20 has its own power and, thus, does not need the power generated by the first lock device 30 or the second lock device 40 through wireless induction. The biological feature pickup device 26 can be a fingerprint pickup device or a finger vein pickup device of the mobile phone. The identification data can be the international mobile equipment identity number (IMEI). The first authenticated identification information is the IMEI stored in the first memory 36. The second authenticated identification information is the IMEI stored in the second memory 46.

When the mobile phone used as the electronic key 20 is near the second lock device 40 on the door 50, the second lock device 40 reads the IMEI. If the second control module 42 identifies that the IMEI does not match the second authenticated identification information in the second memory 46, the second lock body 44 is in the locked state. On the other hand, if the second control module 42 identifies that the IMEI matches the second authenticated identification information in the second memory 46, the second lock body 44 is in the unlocked state to permit subsequent opening of the door 50.

Likewise, when the mobile phone used as the electronic key 20 is near the first lock device 30 on the safe 52, the first lock device 30 reads the IMEI. If the first control module 32 identifies that the IMEI does not match the first authenticated identification information in the first memory 36, the first lock body 34 is in the locked state. On the other hand, if the first control module 32 identifies that the IMEI matches the first authenticated identification information in the first memory 36, the first lock body 34 is in the unlocked state to permit subsequent opening of the safe 52. Note that a hinting message can be displayed on the screen of the mobile phone and/or the speaker of the mobile phone can generate hinting sound to remind the holder to input the biological feature (such as the fingerprints) through the biological feature pickup device 26 for subsequent identification.

An advantage of the control system 10 is that one electronic key 20 can cooperate with a plurality of lock devices 30, 40 to provide lock control functions of different security levels. Namely, unlocking of a lock device of an ordinary security level only requires matching between the identification data in the electronic key 20 and the authenticated identification information in the lock device. Unlocking of a lock device of a higher security level requires a holder to use the biological feature pickup device 26 of the electronic key 20 to input his or her biological feature (which must match the biological feature of the electronic key 20) aside from matching between the identification data in the electronic key 20 and the authenticated identification information in the lock device. Thus, even if the electronic key 20 is lost, a person picking up the electronic key 20 cannot unlock the lock device of the a higher security level. Accordingly, the control system 10 provides a better anti-burglar function.

Furthermore, the lock control functions of different levels provided by the control system 10 can be achieved by a plurality of authenticated identification information inputted by different persons through different lock devices. For example, a first person inputs his or her authenticated biological feature identification information through the first lock device 30, a second person inputs his or her authenticated biological feature identification information through the second lock device 40, and so on. Thus, different persons can use the same electronic key 20 to unlock different locks.

Furthermore, the hinting device 28 of the electronic key 20 can remind the holder of the electronic key 20 to use the biological feature pickup device 26 to input his or her biological feature for opening a lock device of a higher security level. Thus, the user of the electronic key 20 does not have to remember the security levels of the lock devices, providing extreme convenience in use.

The control system 10 can use a single electronic key 20 to control a plurality of lock devices of different security levels, reducing the number of electronic keys to be carried.

The control system 10 can only cooperate with a lock device. Unlocking of this lock device requires a holder to use the biological feature pickup device 26 of the electronic key 20 to input his or her biological feature which must match the biological feature of the electronic key 20 aside from matching between the identification data in the electronic key 20 and the authenticated identification information in the lock device. Thus, even if the electronic key 20 is lost, a person picking up the electronic key 20 cannot unlock the lock device of the a higher security level. Accordingly, the control system 10 provides a better anti-burglar function.

Thus since the illustrative embodiments disclosed herein may be embodied in other specific forms without departing from the spirit or general characteristics thereof, some of which forms have been indicated, the embodiments described herein are to be considered in all respects illustrative and not restrictive. The scope is to be indicated by the appended claims, rather than by the foregoing description, and all changes which come within the meaning and range of equivalency of the claims are intended to be embraced therein.

The invention claimed is:

1. A control system comprising:

a first lock device including a first control module and a first connecting module electrically connected to the first control module, with the first lock device further including a first lock body controlled by the first control module to be in a locked state or an unlocked state, with the first lock device further including a first memory electrically connected to the first control module, and with first authenticated identification information and authenticated biological identification information stored in the first memory;

a second lock device including a second control module and a second connecting module electrically connected to the second control module, with the second lock device further including a second lock body controlled by the second control module to be in a locked state or an unlocked state, with the second lock device further including a second memory electrically connected to the second control module, and with second authenticated identification information stored in the second memory; and an electronic key including a processing module, a main connecting module, and a biological feature pickup device, with the main connecting module and the biological feature pickup device electrically connected to the processing module, with the electronic key further including a main memory and a hinting module, with the main memory and the hinting memory electrically connected to the processing module, with identification data stored in the main memory, with the main connecting module selectively connected to the first connecting module or the second connecting module, wherein the second lock device is configured to be mounted to a first door mounted between a first space and a second space, wherein the first door is movable from a closed position to an open position when the second lock body is in the unlocked state, wherein the first door in the open position permits access from the first space to the second space, wherein the first door in the closed position prevents access from the first space to the second space, wherein the first lock device is configured to be mounted to a second door located in the second space, wherein the second door defines a third space therein, wherein the second door is movable from a closed position to an open position when the first lock body is in the unlocked state, wherein the second door in the open position permits access from the second space to the third space, wherein the second door in the closed position prevents access from the second space to the third space, with the main connecting module of the electronic key connected to the first connecting module of the first lock device, with the hinting module configured to generate a hinting message reminding a holder of the electronic key to use the biological feature pickup module to input biological feature information, with the first lock device configured to read the identification data of the electronic key and the biological feature identification information inputted by the holder, wherein when the first control module identifies that the identification data of the electronic key matches the first authenticated identification information and that the biological identification information matches the authenticated biological identification information, the first control module is configured to control the first lock body to be in the unlocked state to permit opening of the first door, thereby permitting access from the first space to the second space, wherein when the first control module identifies that the identification data of the electronic key does not match the first authenticated identification information or the biological identification information does not match the authenticated biological identification information, the first control module is configured to control the first lock body to be in the locked state preventing opening of the first door, with the main connecting module of the electronic key connected to the second connecting module of the second lock device, the hinting module does not operate, and the second lock device is configured to read the identification data of the electronic key, wherein when the second control module identifies that the identification data of the electronic key matches the second authenticated identification information, the second control module is configured to control the second lock body to be in the unlocked state permitting opening of the second door, thereby permitting access from the second space to the third space, wherein when the second control module identifies that the identification data of the electronic key does not match the second authenticated identification information, the second control module is configured to control the second lock body to be in the locked state preventing opening of the second door.

2. The control system as claimed in claim 1, wherein the electronic key is a door access card, and wherein the hinting device is a light emitting diode.

3. The control system as claimed in claim 2, wherein the electronic key further includes a power supply device electrically connected to the processing module, wherein each of the main connecting module, the first connecting module, and the second connecting module is a wireless connecting device, wherein the power supply device is magnetically inductive wireless charging equipment or magnetic resonance wireless charging equipment, wherein when the electronic key is electrically connected to the first lock device or the second lock device, the power supply device is configured to generate electric current through magnetic induction or magnet resonance and supplies electricity to the processing module, the hinting module, the main memory, the main connecting module, and the biological feature pickup module.

4. The control system as claimed in claim 1, wherein the electronic key is a smart phone, wherein the hinting device is at least one of a screen for displaying a hinting message and a speaker of the smart phone for generating hinting sound, wherein the hinting device, when operated, is configured to generate at least one of the screen with the hinting device and the hinting sound for hinting the holder to input the biological feature.

5. The control system as claimed in claim 4, further comprising a power supply device electrically connected to the processing module, wherein each of the main connecting module, the first connecting module, and the second connecting module is a wireless connecting device, and wherein the power supply device is a battery of a smart phone.

* * * * *